US006773786B1

(12) United States Patent
Kuckart

(10) Patent No.: US 6,773,786 B1
(45) Date of Patent: Aug. 10, 2004

(54) PAPER MACHINE COVER

(75) Inventor: Dieter Kuckart, Kettenis (BE)

(73) Assignee: Asten Privatgesellschaft mit beschraenkter Haftung, Eupen (BE)

( * ) Notice: Subject to any disclaimer, the term of this patent is extended or adjusted under 35 U.S.C. 154(b) by 14 days.

(21) Appl. No.: 10/088,822

(22) PCT Filed: Aug. 16, 2000

(86) PCT No.: PCT/EP00/08000

§ 371 (c)(1),
(2), (4) Date: Mar. 20, 2002

(87) PCT Pub. No.: WO01/21884

PCT Pub. Date: Mar. 29, 2001

(30) Foreign Application Priority Data

Sep. 21, 1999 (DE) ..... 199 45 077

(51) Int. Cl.[7] ..... F26B 13/26

(52) U.S. Cl. ..... 428/141; 428/93; 428/192; 428/196; 428/197; 167/902; 167/358.1; 167/359.1; 34/111; 34/116; 34/123

(58) Field of Search ..... 428/141, 93, 192, 428/196, 197; 162/902, 358.2, 359.1; 34/111, 116, 123

(56) References Cited

U.S. PATENT DOCUMENTS 3,354,022 A * 11/1967 Dettre et al. ..... 428/167
4,395,308 A * 7/1983 Dawes ..... 162/232
4,796,749 A 1/1989 Lefferts
4,943,476 A 7/1990 Sokaris
5,207,873 A * 5/1993 Sanduja et al. ..... 162/358.2
5,324,392 A * 6/1994 Tate et al. ..... 162/348
5,407,737 A * 4/1995 Halterbeck et al. ..... 442/195
5,534,333 A 7/1996 Keller et al.
5,829,488 A * 11/1998 Fagerholm et al. ..... 139/383 A
5,837,102 A 11/1998 Graf
6,057,255 A 5/2000 Gass
6,092,298 A * 7/2000 Salminen et al. ..... 34/71

FOREIGN PATENT DOCUMENTS

| | | |
|---|---|---|
| DE | 718655 | 3/1942 |
| DE | 3735709 | 5/1989 |
| EP | 0576115 | 12/1993 |
| EP | 0786550 | 7/1997 |
| NL | 274554 | 9/1964 |

* cited by examiner

*Primary Examiner*—William P. Watkins, III
(74) *Attorney, Agent, or Firm*—W. F. Fasse; W. G. Fasse

(57) ABSTRACT

In order to prevent the formation and subsequent breaking off of large agglomerations of dirt particles on the cover of a paper machine, at least one surface located opposite of the paper web and pertaining to at least one part of the elements forming a contact surface is provided, at least partially, with an average surface roughness of between 5 $\mu$m and 100 $\mu$m. (FIG. 4)

34 Claims, 3 Drawing Sheets

PAPER MACHINE COVER

BACKGROUND INFORMATION

Such paper machine covers which revolve continuously on rollers usually concern dryer cloths for example which are used to dehumidify the paper web, especially by the supply of heat. Heat permeability, resistance to wear and tear, the ability to permeate and entrain air, as well as the surface structure are the essential features of such dryer cloths in order to achieve perfect quality of the paper web to be dried.

It is generally known to design such dryer cloths, which usually concern flexible planar objects, as fabrics, knitted fabrics, spiralized goods or support segments which are flexibly connected with one another and are usually produced as injection-molded parts. The most frequently used ones are woven dryer cloths, followed by such in form of spiralized goods.

In the two aforementioned types of dryer cloths the soiling of the contact surface of the cloth which faces the paper has proven most recently to be a particularly problematic point. One reason for the increasing soiling problem in the dryer section of paper machines is the increasing use of waste paper in paper production. Whereas the waste paper share in Germany is on the average 60% for example, waste paper shares of 100% are reached occasionally, which leads to particular problems with the soiling of the dryer cloths. The type and composition of "soiling" are numerous: Resins, oils, greases, tar, so-called hot melts, starch, adhesive impurities (so-called "stickies") or plastic binders (so-called "white pitch"), which may be present in combined form under certain circumstances, contribute to the soiling. The types of soiling may occur in solid, adhesive or dissolved form. Usually, the size of the dirt particles is below 150 $\mu$m.

Deposits of dirt particles on dryer cloths pose a problem because they impair relevant cloth properties such as the air permeability and the ability to entrain air, as well as paper contact and the heat permeability. This obstructs the even drying and perfect transport of the paper web. Moreover, the energy demand required for drying rises and the service life of the cloths decreases. Whereas deposits adhering to the contact surface of the cloth may cause an uneven humidity profile and possible detachments of the paper web, the deposits produce holes or thin places in the paper web after their detachment from the cloth which have a negative effect on the later printability of the paper.

Further developments of dryer cloths were made in the past with the predominant goal to increase the share of the contact surface in the overall surface area of the cloth in order to improve both the drying as well as the transport properties in this way. Such a goal orientation of the development can be noticed especially in the construction of dryer cloths for fast-running paper machines in particular. In one form of fabric construction the contact surface is defined as the sum total of the numerous individual surfaces of individual cloth wires which come into contact with the paper web.

The contact surface could be increased to a substantial extent with the introduction of long-floating cloth designs as compared with cloth fabric designs with simple skeining longitudinal wires. Usually, round or rectangular wire cross sections were processed. A further substantial enlargement of the contact surface could be achieved by the use of so-called flat strips as longitudinal wires, i.e. in the direction of the running direction of the machine. Wires are called flat strips whose ratio of width to thickness is substantially larger (e.g. 3:1) than in conventional flat wires. With such cloth designs based on the flat strip technology it is possible to achieve contact surfaces of close to 60%. In contrast to the cloths made of round or rectangular wires, such cloth designs offer a contact surface which is composed of fewer but larger contact areas instead of such with more, but smaller contact areas.

If possible, a cloth cleaning system is installed in the areas of the dryer section which are at the front as seen in the running direction of the machine, which cloth cleaning system may come with a continuous or periodic operating mode. In this part of the dryer section the paper web still has a relatively high humidity content and is therefore particularly sensitive with respect to the entrainment of dirt particles which detach from the contact side of the dryer cloth.

Especially in cases in which no (efficient) cleaning system can be installed in said front sections of the dryer section relatively large dirt particles can form, which depends on the composition of the paper material, the process conditions and the type of dirt particles. As such, they can detach from the cloth surface, whereby they cause quality impairments in the paper due to their size.

SUMMARY OF THE INVENTION

The invention is based on the object of providing a cover for a paper machine in which the inclination towards the adherence of dirt particles is reduced. Furthermore, the size from which the agglomerated dirt particles detach from the contact surface is to be reduced.

This object is achieved in accordance with the invention by a cover in which at least the surface facing the paper web of at least one part of the elements forming the contact surface comprises at least partially an averaged surface roughness of between 5 $\mu$m and 100 $\mu$m. The determination of the averaged surface roughness is carried out based on the DIN EN ISO 4287. If the adherence to the definitions as contained therein concerning the measured length is not possible because a measurement transversally to the longitudinal direction of a narrow tape, it is possible to use alternatively a contactless laser measurement.

The invention is based on the finding that a cover with a surface roughness of the contact surfaces in the aforementioned range does not comprise any concatenated larger contact areas as a result of the limited flexibility of the paper web, which contact areas could be used by the dirt particles as adhering surfaces. In contrast to previously known covers, growing agglomerations of dirt particles will detach from the cover in accordance with the invention before they can reach a size critical for leading to quality problems in the paper web. The surface areas facing the paper web of the elements forming the contact surface in covers according to the state of the art usually comprise an averaged surface roughness in the range of between approx. 1.5 and 3.0 $\mu$m. This surface roughness is thus substantially lower than the one proposed in accordance with the invention and is obtained especially from the usual production methods for the elements forming the contact surfaces, namely extrusion in wires or strips or injection molding for flexibly connected support segments. In said production processes the elements are realized with the lowest possible viable surface roughness for economic reasons in order to meet the common assumption that the smoothest possible surface should lead to the lowest possible inclination towards soiling.

In contrast to this, it was recognized with the present invention that in view of the "first-order surface structure"

(coarse structure) as achieved for example by the type of fabric and the thread dimensions used therein (wires or strips) and the type of binding, the realization of the largest possible individual surfaces may be useful. The same applies for example to the dryer cloths made of injection molded segments. At least the contact surfaces of said first-order surface structures should be provided in accordance with the invention with an additional "second-order surface structure" (fine structure) which lies in the range of the aforementioned averaged surface roughness. In cooperation with the given flexibility of the paper web to be conveyed, such a surface provided with the fine structure acts as a virtually plane contact surface with the advantage that markings on the paper web can hardly be caused by said fine structure. Due to the planarly reduced individual contact areas, the fine structure produces a clearly improved possibility for detachment especially for dirt particles produced by agglomeration, so that the same will detach at a considerably earlier time, i.e. with a substantially smaller size, and will therefore not lead to the known decreases in quality on the paper surface.

In a preferred embodiment of the invention the cover is a fabric, with at least a part of its longitudinal threads having an averaged surface roughness of between 5 μm and 100 μm at the surface facing the paper web.

Such an embodiment is preferable for production reasons because the fine structure of the cover can be realized by maintaining the usual weaving techniques and types of binding already during the production of the longitudinal threads for example, e.g. by way of extrusion.

In covers in which a substantial part of the contact surface is formed by threads extending transversally to the running direction of the machine it makes sense conversely that transversal threads of the fabric have an averaged surface roughness of between 5 μm and 100 μm at least in the surface facing the paper web.

In a further development of the invention it is provided that longitudinal and/or transversal threads of the fabric are profiled in the cross section. Especially in the case of producing the threads by way of extrusion, does this prove to be particularly uncomplicated from a production viewpoint.

As an alternative it is also possible that threads are profiled in a longitudinal section.

An also very appropriate embodiment of the invention is that the elements forming the contact surface towards the paper web are spirally extending threads whose surface facing the paper web comprises an averaged surface roughness of between 5 μm and 100 μm.

It is moreover within the scope of the invention that the elements forming the contact surface towards the paper web are injection-molded segments which are each connected flexibly with adjacent injection-molded elements at least in the longitudinal direction of the dryer cloth and whose surface facing the paper web comprises at least partly an averaged surface roughness of between 5 μm and 100 μm.

A particularly effective prevention of dirt particle accumulations and agglomerations occurs in the range of an averaged surface roughness of between 10 μm and 80 μm. Preferably, a surface roughness of between 30 μm and 70 μm should be realized.

A further development of the cover in accordance with the invention is that the elements forming the contact surface consist of two different materials.

This allows providing the layer facing the paper web with the surface roughness in accordance with the invention and, at the same time, to take material properties into account which lead to a particularly favorable paper conveyance and a lower tendency for the adherence of particles. By choosing suitable materials for a bottom layer averted from the paper web it is also possible at the same time to ensure the strength properties and the heat conductivity properties of the cover for example.

A particularly advantageous possibility for achieving a multi-layer element for forming the contact surface is that the surface facing the paper web of the elements forming the contact surface is produced by coating a basic body. In principle, both the coating of a finished cover such as a fabric or the coating of individual elements such as the threads or the injection-moulded elements composing the cover are possible.

Finally, it is provided for in accordance with the invention that the elements forming the contact surface are produced by way of a multi-component extrusion in order to ensure an intimate connection between the different materials of the elements.

BRIEF DESCRIPTION OF THE DRAWINGS

The invention is now explained in closer detail by reference to several embodiments of elements from which the dryer cloth in accordance with the invention can be composed and which are shown in the drawings, wherein.

DETAILED DESCRIPTION OF PREFERRED EXAMPLE EMBODIMENTS OF THE INVENTION

Figures 1, 2, 3:
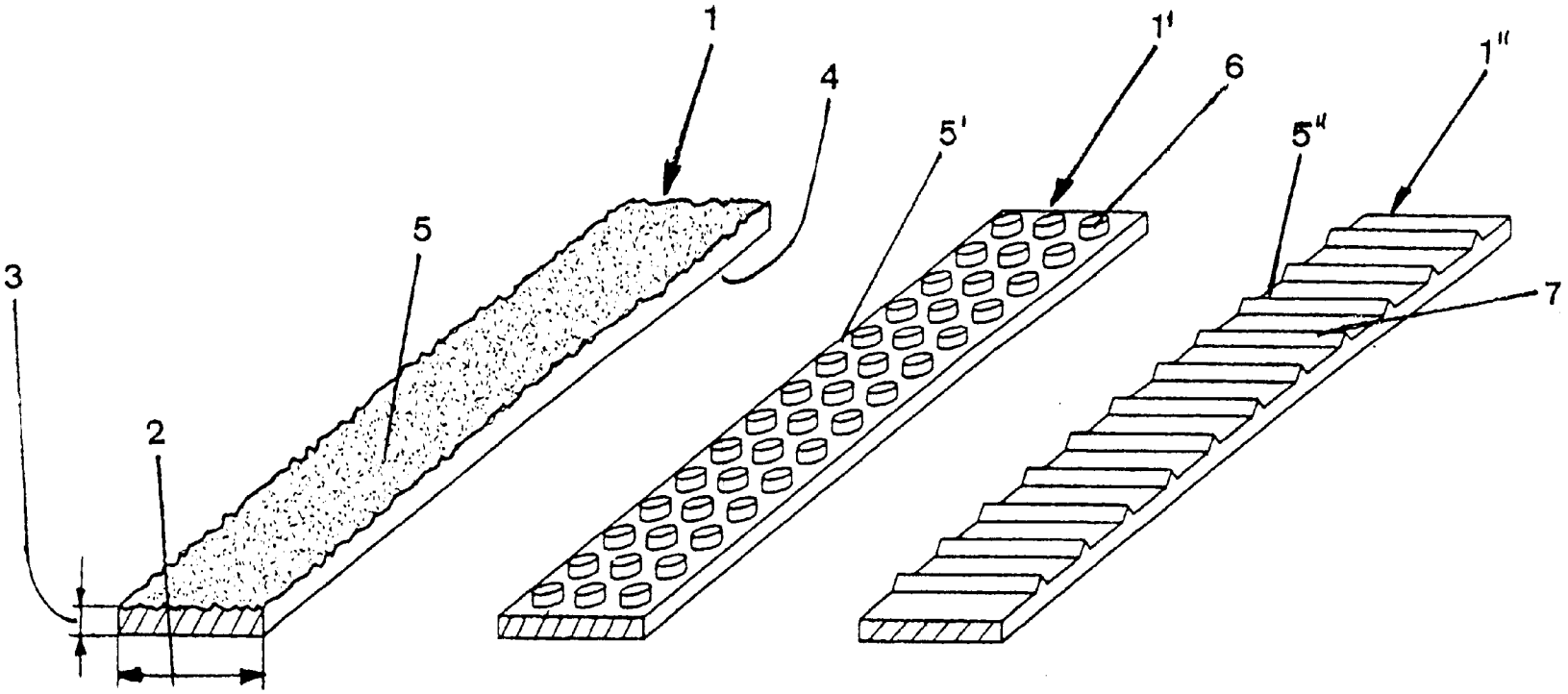
FIGS. 1 through 9 shows sections of strips or wires which are profiled especially in the longitudinal direction in order to form a dryer cloth fabric or a dryer cloth in form of spiralized ware.

A section of a flat strip 1 as shown in FIG. 1 in a perspective view is provided with a ratio of width 2 to thickness 3 which is disposed in the range of approximately 4:1. Whereas the surface of the flat strip 1 which is produced by way of extrusion is smooth on the one side (surface 4), the surface 5, which during the processing of the strip 1 into a weaved dryer cloth forms the contact surface to the paper web in sections, is structured irregularly. Said structured surface 5 is provided with an averaged surface roughness of between 5 μm and 100 μm. Such structurings can be produced by way of embossing the still incompletely cured plastic material.

The flat strip 1' as represented in FIG. 2 differs from the one shown in FIG. 1 by the regular structure of its surface 5' which comprises three parallel rows of cylindrical peaks 6 which extend in the longitudinal direction. The peaks 6 are disposed in each row at the same distance from one another and also form rows extending in the transversal direction of the flat strip 1'.

Alternatively, the peaks 6 can also be conical or rounded off in the shape of a knob.

In the flat strip 1" as shown in FIG. 3, the surface 5 " is provided with elevations 7 which extend in the transversal direction of the flat strip 1" and which are triangular as seen in their cross section. The individual elevations 7 are, as seen in the longitudinal direction of the flat strip 1", always disposed at the same distance from one another.

In all flat strips 1, 1' and 1" according to FIGS. 1 to 3 it is also possible to provide both opposite surfaces with the same or with a different structuring.

It is also possible to use instead of flat strips which are processed into a weaved dryer cloth or one composed of spirals injection-molded segments with surface structures as represented in FIGS. 1 to 3 that have the roughness intervals in accordance with the invention.

Figure 4:
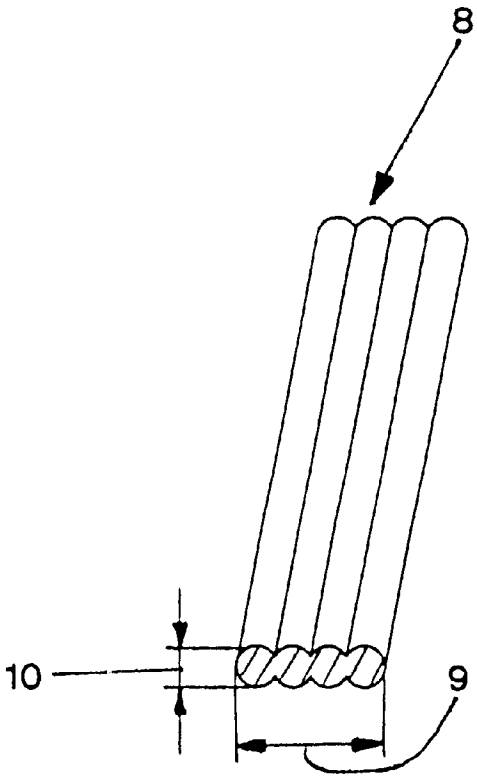

FIG. 4 shows a view of a section of a flat strip 8 which is composed in the cross section of four individual wires which are approximately circular in the cross section. The individual wires are homogeneously connected by way of sufficiently large connection surfaces. The production of the flat strip 8 according to FIG. 4 occurs by way of extrusion through a die provided with a respective arrangement in its cross section. The ratio of width 9 to thickness 10 of the flat strip 8 is approx. 4:1. The constrictions in the zone of the transition between two abutting round wires is approximately 20% of the thickness 10 from each side. The thickness 10 is 0.15 mm to 0.3 mm.

Figure 5:
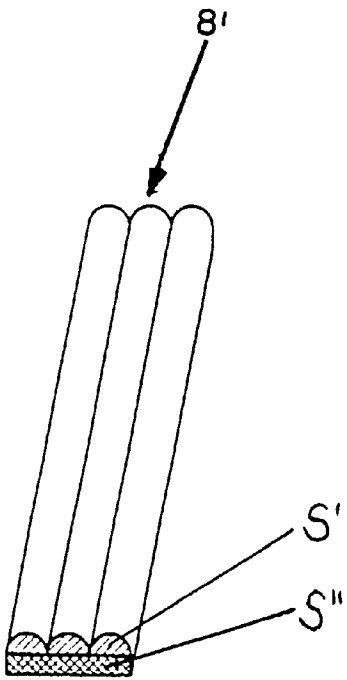

Whereas the flat strip 8 according to FIG. 4 is provided with constrictions on both sides and therefore comprises a surface roughness in the interval according to the invention, this is the case only on one side in connection with the flat strip 8' according to FIG. 5. The ratio of width to thickness is approx. 3:1 in this case, and the depth of the constrictions correspond to approximately 40% of the thickness which amounts to approximately 0.15 mm. The flat strip 8' is composed of two layers S' and S", of which the upper layer S' which is provided with a structured surface faces the paper web in the dryer cloth fabric and therefore forms the contact surface in sections. The lower layer S" is especially optimized with respect to the strength properties.

Figure 6:
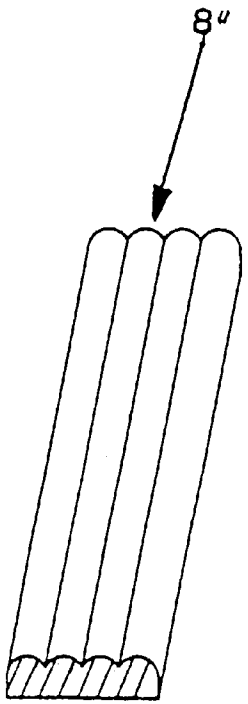

Whereas the flat strip 8' according to FIG. 5 appears to be composed of three individual strips, there are four individual wires in the flat strip 8" according to FIG. 6. The depth of the constriction is lower in the flat strip 8" then in the flat strip 8'.

Figures 7, 8, 9:
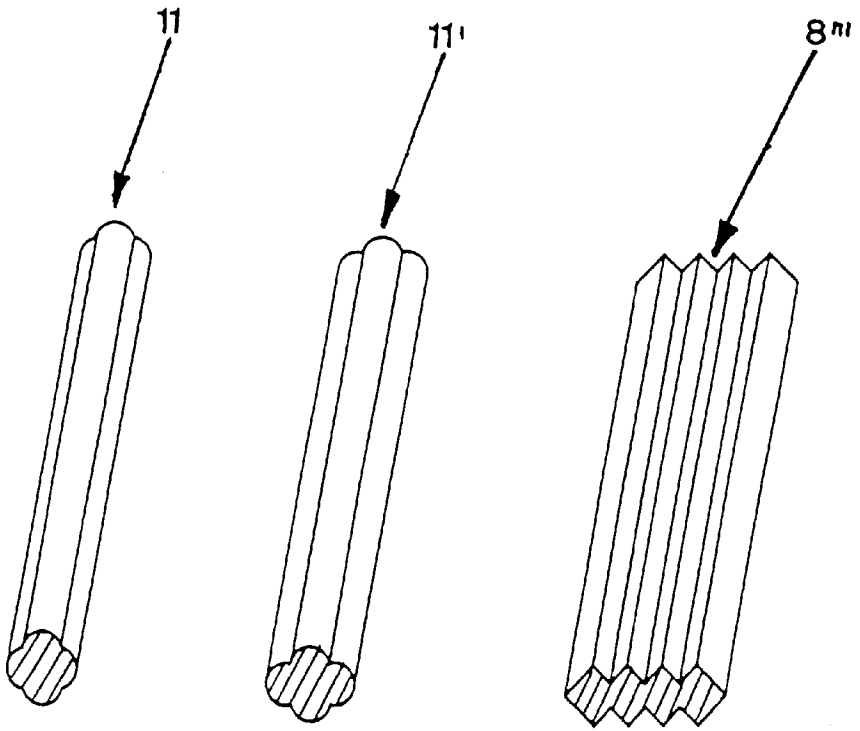

FIGS. 7 and 8 show further possible cross-sectional shapes for wires 11 and 11' whose surface roughness, as measured transversally to the longitudinal direction of the wires, is disposed in the interval in accordance with the invention.

FIG. 9 finally shows a flat strip 8" which is composed of four individual wires with a cross section in the form of squares positioned on their tips.

Dryer cloths are produced according to the invention from all flat strips or wires according to the FIGS. 1 to 9. The flat strips or wires can be used in threads extending both in the longitudinal direction of the machine as well as such extending transversally to the longitudinal direction of the machine. The relevant aspect for the occurrence of the success of an early detachment of dirt particles is the fact that the profiled surface of the flat strip or wire forms the only surface of the contact surface to the paper web. It is certainly possible in this respect to use non-profiled or differently profiled strips for the longitudinal edges of the cover instead of the flat strips provided for use in the central part and as described above.

What is claimed is:

1. Dryer cloth of a paper machine, characterized in that at least the surface facing the paper web of at least a part of the elements forming the contact surface has at least partly a surface roughness between 5 $\mu$m and 100 $\mu$m, whereby the elements forming the contact surface are formed by the longitudinal threads and/or transverse threads of a woven fabric.

2. Dryer cloth according to claim 1, characterized in that the longitudinal and/or transverse threads of the woven fabric are profiled in the cross section.

3. Dryer cloth according to claim 1, characterized in that the longitudinal and/or transverse threads of the woven fabric are profiled in the longitudinal section.

4. Dryer cloth according to claim 1, characterized in that at least the surface facing the paper web of the elements forming the contact surface has at least partly a surface roughness between 10 $\mu$m and 80 $\mu$m.

5. Dryer cloth according to claim 1, characterized in that at least the surface facing the paper web of the elements forming the contact surface has at least partly a surface roughness between 30 $\mu$m and 70 $\mu$m.

6. Dryer cloth according to claim 1, characterized in that the elements forming the contact surface consist layer-wise of at least two different materials.

7. Dryer cloth according to claim 6, characterized in that the surface facing the paper web of the elements forming the contact surface is produced by coating a basic body.

8. Dryer cloth according to claim 6, characterized in that the elements forming the contact surface are produced by way of a multi-component extrusion.

9. A paper web dryer support for a dryer section of a paper machine, wherein:

said dryer support has a contact surface adapted to face and contact a paper web being supported thereon in the dryer section of the paper machine, said dryer support comprises plural support elements that are interconnected with one another and that have contact surface areas which together form said contact surface of said dryer support, and at least some of said contact surface areas of said support elements have a surface structure with a surface roughness in a range from 5 $\mu$m to 100 $\mu$m.

10. The paper web dryer support according to claim 9, wherein said support elements are individual injection-molded elements that are flexibly linked with one another to form said dryer support as a linked succession of adjacent ones of said individual injection-molded elements.

11. The paper web dryer support according to claim 9, wherein said support elements comprise longitudinal threads extending in a running direction of said dryer support in a plane of said dryer support and transverse threads extending transversely relative to said longitudinal threads in said plane of said dryer support, wherein said dryer support comprises a woven dryer fabric of said longitudinal threads and said transverse threads interwoven with each other, and wherein at least some of said threads have said contact surface areas having said surface structure with said surface roughness.

12. The paper web dryer support according to claim 9, wherein said surface structure has a profiled surface contour along a cross-section through a respective one of said support elements, wherein said profiled surface contour provides said surface roughness.

13. The paper web dryer support according to claim 9, wherein said surface structure has a profiled surface contour along a longitudinal-section through a respective one of said support elements, wherein said profiled surface contour provides said surface roughness.

14. The paper web dryer support according to claim 9, wherein said surface roughness is in a range from 10 $\mu$m to 80 $\mu$m.

15. The paper web dryer support according to claim 9, wherein said surface roughness is in a range from 30 $\mu$m to 70 $\mu$m.

16. The paper web dryer support according to claim 9, wherein said support elements further have back surface areas that face opposite said contact surface areas and that do not have said surface structure and are smooth relative to said surface roughness of said contact surface areas.

17. The paper web dryer support according to claim 9, wherein at least some of said support elements are flat strips having a width greater than a thickness thereof.

18. The paper web dryer support according to claim 17, wherein said width is at least three times said thickness.

19. The paper web dryer support according to claim 9, wherein said surface structure comprises an irregular roughened texture of said contact surface areas.

20. The paper web dryer support according to claim 9, wherein said surface structure comprises a regular pattern of discrete protrusions that are discontinuous in a longitudinal direction along a length of a respective one of said support elements and in a transverse direction that is transverse relative to said longitudinal direction.

21. The paper web dryer support according to claim 9, wherein said surface structure comprises successive raised ridges that each extend transversely relative to a longitudinal extension of a respective one of said support elements.

22. The paper web dryer support according to claim 9, wherein a respective one of said support elements has a cross-sectional shape made up of plural circles or semi-circles fused together such that said surface structure thereof comprises parallel adjacent longitudinally extending ridges that each have a partial-circular arc-shaped cross-section.

23. The paper web dryer support according to claim 9, wherein a respective one of said support elements has a cross-sectional shape made up of plural squares or diamonds fused together such that said surface structure thereof comprises parallel adjacent longitudinally extending ridges that each have a triangular cross-section.

24. The paper web dryer support according to claim 23, wherein said plural squares or diamonds are fused together side-by-side in a single layer of said squares or diamonds, so that said respective support element is a flat strip with a width thereof being at least three times a thickness thereof.

25. The paper web dryer support according to claim 9, wherein at least a respective one of said support elements has a multi-layered construction including a first layer of a first material on a second layer of a second material different from said first material, and wherein said first layer has said surface structure with said surface roughness.

26. A dryer fabric for a dryer section of a paper making machine, comprising plural interconnected yarns, wherein:

said dryer fabric has a contact surface adapted to face and contact a paper sheet that is to be dried in the dryer section of the paper making machine;

said yarns include first yarns that respectively have contact surface areas which together contribute to said contact surface of said dryer fabric; and each one of said first yarns respectively has a cross-sectional shape made up of plural circles or semi-circles or squares fused together side-by-side, such that said contact surface area of each one of said first yarns comprises parallel adjacent longitudinally extending ridges that each have a partial-circular arc-shaped cross-section or a triangular cross-section.

27. The dryer fabric according to claim 26, wherein said contact surface area of each one of said first yarns including said longitudinally extending ridges has a surface roughness in a range from 5 $\mu$m to 100 $\mu$m.

28. The dryer fabric according to claim 27, wherein said cross-sectional shape of each one of said first yarns is made up of said plural circles fused together such that said longitudinally extending ridges each have said partial-circular arc-shaped cross-section and such that a back surface area of each one of said first yarns facing opposite said contact surface area comprises further a longitudinally extending ridges that each have a partial-circular arc-shaped cross-section.

29. The dryer fabric according to claim 28, wherein said cross-sectional shape of each one of said first yarns consists of at least three of said circles fused together side-by-side.

30. The dryer fabric according to claim 28, wherein said cross-sectional shape of each one of said first yarns consists of four of said circles fused together side-by-side.

31. The dryer fabric according to claim 27, wherein said cross-sectional shape of each one of said first yarns is made up of said plural semi-circles fused together such that said longitudinally extending ridges each have said partial-circular arc-shaped cross-section and such that a back surface area of each one of said first yarns facing opposite said contact surface area is flat and without said longitudinally extending ridges.

32. The dryer fabric according to claim 27, wherein said cross-sectional shape of each one of said first yarns is made up of said plural squares fused together such that said longitudinally extending ridges each have said triangular cross-section and such that a back surface area of each one of said first yarns facing opposite said contact surface area comprises further longitudinally extending ridges that each have a triangular cross-section.

33. The dryer fabric according to claim 26, wherein said plural interconnected yarns further comprise second yarns that are interwoven with said first yarns so as to interconnect said first and second yarns, and said cross-sectional shape of each one of said first yarns is made up of said plural circles fused together such that said longitudinally extending ridges each have said partial-circular arc-shaped cross-section.

34. The dryer fabric according to claim 33, wherein said contact surface area of each one of said first yarns including said longitudinally extending ridges has a surface roughness in a range from 5 $\mu$m to 100 $\mu$m.

* * * * *

UNITED STATES PATENT AND TRADEMARK OFFICE

CERTIFICATE OF CORRECTION

PATENT NO. : 6,773,786 B1
DATED : August 10, 2004
INVENTOR(S) : Kuckart

It is certified that error appears in the above-identified patent and that said Letters Patent is hereby corrected as shown below:

Title page, Item [54] and Column 1, line 1,
Replace "PAPER MACHINE COVER" by -- DRYER FABRIC FOR PAPER MAKING MACHINE --;
Item [57], ABSTRACT,
Delete the whole paragraph and replace as follows:

--In order to prevent the formation and subsequent breaking off of large agglomerations of dirt particles on the paper web support such as a dryer fabric in the dryer section of a paper making machine, at least some of the elements and particularly yarns forming the dryer fabric have a contact surface area that faces and contacts the paper web and that has an average surface roughness of between 5 μm and 100μm.--;

Column 4,
Line 27, replace "FIGS." by -- FIG. --;
Line 66, after "strips" insert -- , --;

Column 5,
Line 1, after "spirals" insert -- , --;
Line 21, after "thickness" insert -- , --;
Line 38, after "strip", replace "8'"" by -- 8'' --;

Column 8,
Line 14, after "further" delete -- a --.

Signed and Sealed this

Eighteenth Day of January, 2005

JON W. DUDAS
*Director of the United States Patent and Trademark Office*